US012708179B2

(12) United States Patent
Chen et al.

(10) Patent No.: US 12,708,179 B2
(45) Date of Patent: Aug. 18, 2026

(54) CUSHIONED UPPER FOR AN ARTICLE OF FOOTWEAR

(71) Applicant: NIKE, Inc., Beaverton, OR (US)

(72) Inventors: Yuchung K. Chen, Portland, OR (US); Jeremy L. Connell, Hillsboro, OR (US); Dervin A. James, Hillsboro, OR (US); Tetsuya T. Minami, Portland, OR (US); Arthur Parker Molinari, Portland, OR (US); Stuart Reinhardt, Beaverton, OR (US); Timothy J. Smith, Portland, OR (US); Matthew Tegenkamp, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 255 days.

(21) Appl. No.: 17/330,346

(22) Filed: May 25, 2021

(65) Prior Publication Data

US 2021/0368941 A1 Dec. 2, 2021

Related U.S. Application Data

(60) Provisional application No. 63/032,146, filed on May 29, 2020.

(51) Int. Cl.
*A43B 23/02* (2006.01)

(52) U.S. Cl.
CPC ..... *A43B 23/028* (2013.01); *A43B 23/0235* (2013.01); *A43B 23/0265* (2013.01)

(58) Field of Classification Search
CPC ..... A43B 23/028; A43B 23/0235; A43B 23/0265; A43B 23/08
USPC ..... 36/45, 133, 72 R
See application file for complete search history.

(56) References Cited

U.S. PATENT DOCUMENTS

| | | | | |
|---|---|---|---|---|
| 3,703,775 | A | 11/1972 | Gatti | |
| 8,215,032 | B2 * | 7/2012 | Sokolowski | A43B 23/042 36/71 |
| 8,230,617 | B2 * | 7/2012 | Luedecke | A43B 5/08 36/8.1 |
| 8,950,088 | B2 * | 2/2015 | Aveni | A43B 23/0235 36/54 |
| 9,009,992 | B2 * | 4/2015 | Baker | A43C 11/1493 36/133 |
| 10,905,197 | B2 * | 2/2021 | Lee | B29D 35/0072 |

(Continued)

FOREIGN PATENT DOCUMENTS

| | | | | |
|---|---|---|---|---|
| DE | 9214715 U1 | | 3/1994 | |
| GB | 2454737 A | * | 5/2009 | A43B 23/028 |

OTHER PUBLICATIONS

DE9214715U1 Translation—1992—Dassler.*

(Continued)

*Primary Examiner* — Alissa J Tompkins
*Assistant Examiner* — Catherine M Ferreira
(74) *Attorney, Agent, or Firm* — Honigman LLP; Matthew H. Szalach

(57) ABSTRACT

An upper for an article of footwear includes an inner boot having an ankle opening and an instep region formed between the ankle opening and an anterior end of the upper and a cushioning member disposed over the instep region of the inner boot and including a first side fixed to a medial side of the upper and a second side tethered to a lateral side of the upper.

20 Claims, 10 Drawing Sheets

(56) References Cited

U.S. PATENT DOCUMENTS

2006/0230636 A1* 10/2006 Kokstis ..... B29D 35/142 36/35 B
2009/0083998 A1* 4/2009 Luedecke ..... A43B 5/08 36/89
2009/0100712 A1* 4/2009 Baker ..... A43B 23/26 36/114
2010/0299967 A1* 12/2010 Atsumi ..... A43B 5/02 36/133
2012/0102613 A1* 5/2012 Loth ..... A61F 13/08 2/22
2012/0180340 A1* 7/2012 Crowley, II ..... A43B 1/0027 36/103
2012/0233879 A1* 9/2012 Dojan ..... B29D 35/128 428/156
2012/0233888 A1* 9/2012 Baker ..... A43B 5/025 36/133
2014/0202043 A1* 7/2014 Aveni ..... A43B 23/0215 36/3 R
2014/0352179 A1* 12/2014 Bell ..... D04B 21/207 66/170
2016/0081419 A1* 3/2016 Theoklitos ..... A43B 23/0245 36/128
2017/0099908 A1* 4/2017 Lee ..... A43C 11/006
2017/0202310 A1* 7/2017 Spanks ..... A43B 19/00
2017/0347742 A1* 12/2017 Turner ..... A41D 13/0587
2019/0082777 A1* 3/2019 Adami ..... A43B 23/0275
2019/0328075 A1* 10/2019 Poulsen ..... D04B 1/12
2019/0380441 A1* 12/2019 Lee ..... A43B 23/0235
2020/0054081 A1* 2/2020 Henry ..... A41D 13/05

OTHER PUBLICATIONS

DE9214715U1 Translation—1992—Dassler (Year: 1992).*
DE9214715U1 Original Document (Year: 1992).*
European Patent Office, PCT International Search Report/Written Opinion dated Aug. 23, 2021 for application No. PCT/US2021/034113.

* cited by examiner

CUSHIONED UPPER FOR AN ARTICLE OF FOOTWEAR

CROSS REFERENCE TO RELATED APPLICATIONS

This application claims priority under 35 U.S.C. § 119(e) to U.S. Provisional Application No. 63/032,146, filed on May 29, 2020. The disclosure of this prior application is considered part of the disclosure of this application and is hereby incorporated by reference in its entirety.

FIELD

The present disclosure relates generally to articles of footwear, and more particularly, to uppers for articles of footwear.

BACKGROUND

This section provides background information related to the present disclosure which is not necessarily prior art.

Articles of footwear conventionally include an upper and a sole structure. The upper may be formed from any suitable material(s) to receive, secure and support a foot on the sole structure. The upper may cooperate with laces, straps, or other fasteners to adjust the fit of the upper around the foot. For instance, laces may be tightened to close the upper around the foot. A bottom portion of the upper, proximate to a bottom surface of the foot, attaches to the sole structure.

Sole structures generally include a layered arrangement extending between an outsole providing abrasion-resistance and traction with a ground surface and a midsole disposed between the outsole and the upper for providing cushioning for the foot. In some configurations, the outsole includes traction elements such as cleats for enhancing traction on a turf surface. Such cleats are often incorporated in articles of footwear intended for use during athletic activities such as soccer, football, and/or lacrosse.

While conventional articles of footwear include an upper that secures and supports a foot of a wearer and an outsole that provides traction with a ground surface, such articles of footwear may not include elements that aid a wearer during a specific athletic activity. For example, conventional uppers may lack a ball-control feature designed specifically for use in controlling a ball while playing soccer. Further, even if such articles include a ball-control feature, such feature(s) do not typically aid in further protecting the wearer's foot but, rather, are only concerned with contacting and controlling a soccer ball during use.

DRAWINGS

The drawings described herein are for illustrative purposes only of selected configurations and are not intended to limit the scope of the present disclosure.

FIG. 1 top-front-lateral perspective view of an article of footwear according to the principles of the present disclosure;

Corresponding reference numerals indicate corresponding parts throughout the drawings.

DETAILED DESCRIPTION

Figure 1:
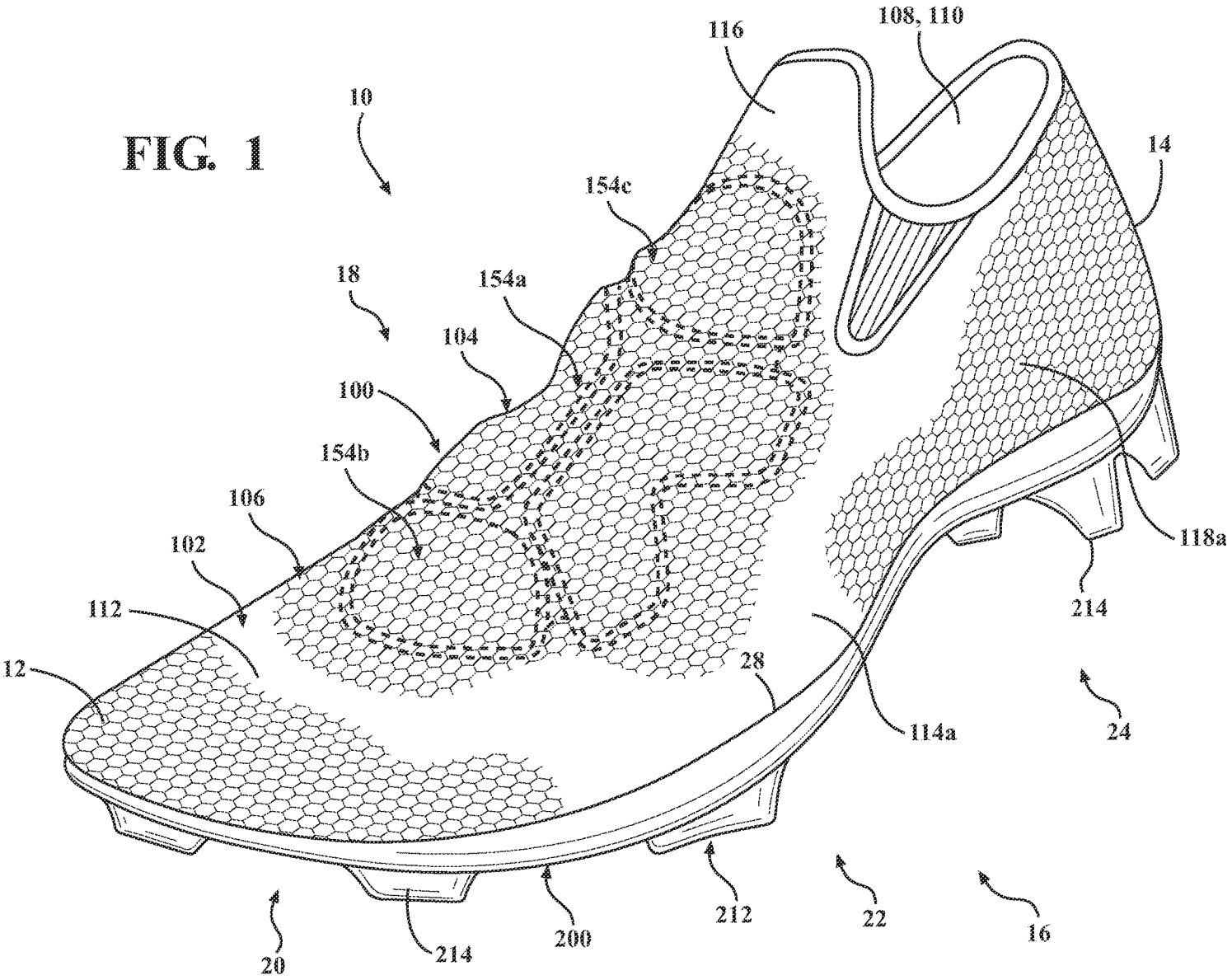

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/ or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an upper for an article of footwear includes an inner boot having an ankle opening and an instep region formed between the ankle opening and an anterior end of the upper and a cushioning member disposed over the instep region of the inner boot and including a first side fixed to a medial side of the upper and a second side tethered to a lateral side of the upper.

The upper may include one or more of the following optional features. Namely, the cushioning member may include one or more compressible pads. Each of the compressible pads may include a chamber having a compressible material disposed therein. Further, one or more of the compressible pads may include a central pad and a pair of secondary pads disposed at opposite ends of the central pad. In one configuration, the central pad may be X-shaped.

The inner boot may include a knitted mesh material. Additionally or alternatively, a shroud may be attached to the inner boot and may at least partially cover the cushioning member. The shroud may include a plurality of perforations through which the cushioning member is exposed.

The second side of the cushioning member may be detached from the inner boot. Additionally or alternatively, the second side of the cushioning member may be tethered to the lateral side of the upper by a plurality of connecting strands.

In another configuration, an upper for an article of footwear includes an inner boot having an ankle opening and an instep region formed between the ankle opening and an anterior end of the upper and a cushioning member disposed over the instep region of the inner boot and including a peripheral portion attached to one of a medial side and a lateral side of the inner boot and an interior portion detached from the inner boot.

The upper may include one or more of the following optional features. Namely, the cushioning member may include one or more compressible pads. Each of the compressible pads may include a chamber having a compressible material disposed therein. Additionally or alternatively, the one or more compressible pads may include a central pad and a pair of secondary pads disposed at opposite ends of the central pad. In one configuration, the central pad may be X-shaped.

The inner boot may include a knitted mesh material. Further, a shroud may be attached to the inner boot and may at least partially cover the cushioning member. The shroud may include a plurality of perforations through which the cushioning member is exposed.

In one configuration, a first portion of the peripheral portion may be detached from the inner boot. Additionally or alternatively, a first portion of the peripheral portion may be tethered to the upper by a plurality of connecting strands.

The details of one or more implementations of the disclosure are set forth in the accompanying drawings and the description below. Other aspects, features, and advantages will be apparent from the description and drawings, and from the claims.

Figure 4:
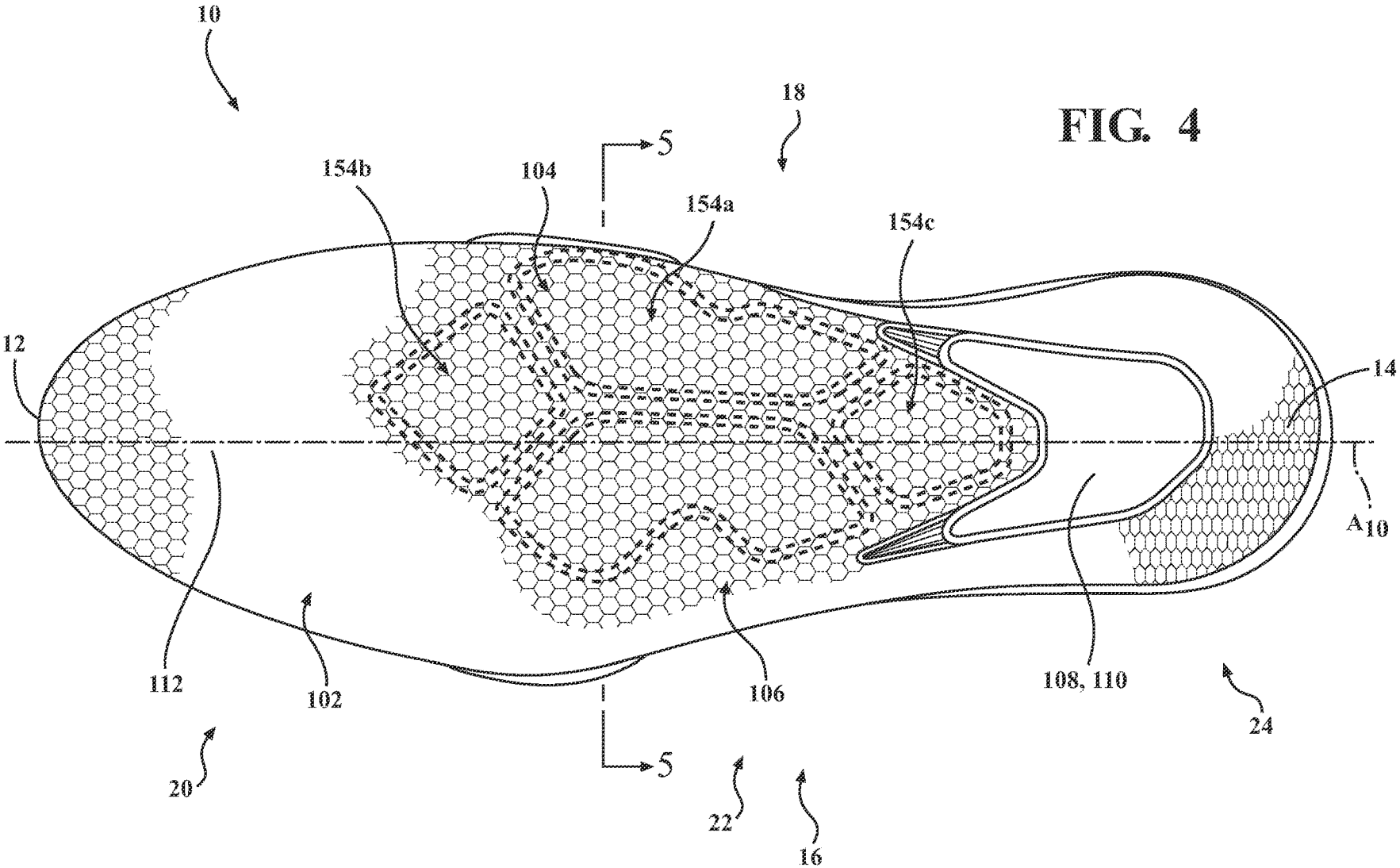
FIG. 4 is a top plan view of the article of footwear of FIG. 1.

Referring to FIG. 1, an article of footwear 10 includes an upper 100 and sole structure 200. The footwear 10 may further include an anterior end 12 associated with a forward-most point of the footwear, and a posterior end 14 corresponding to a rearward-most point of the footwear 10. As shown in FIG. 4, a longitudinal axis $A_{10}$ of the footwear 10 extends along a length of the footwear 10 from the anterior end 12 to the posterior end 14 parallel to a ground surface, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the lateral side 16 to the medial side 18. The article of footwear 10 may be divided into one or more regions. The regions may include a forefoot region 20, a mid-foot region 22, and a heel region 24. The forefoot region 20 corresponds with phalanges and a ball portion of a foot. The mid-foot region 22 may correspond with an arch area of the foot, and the heel region 24 may correspond with rear portions of the foot, including a calcaneus bone.

Figure 3:
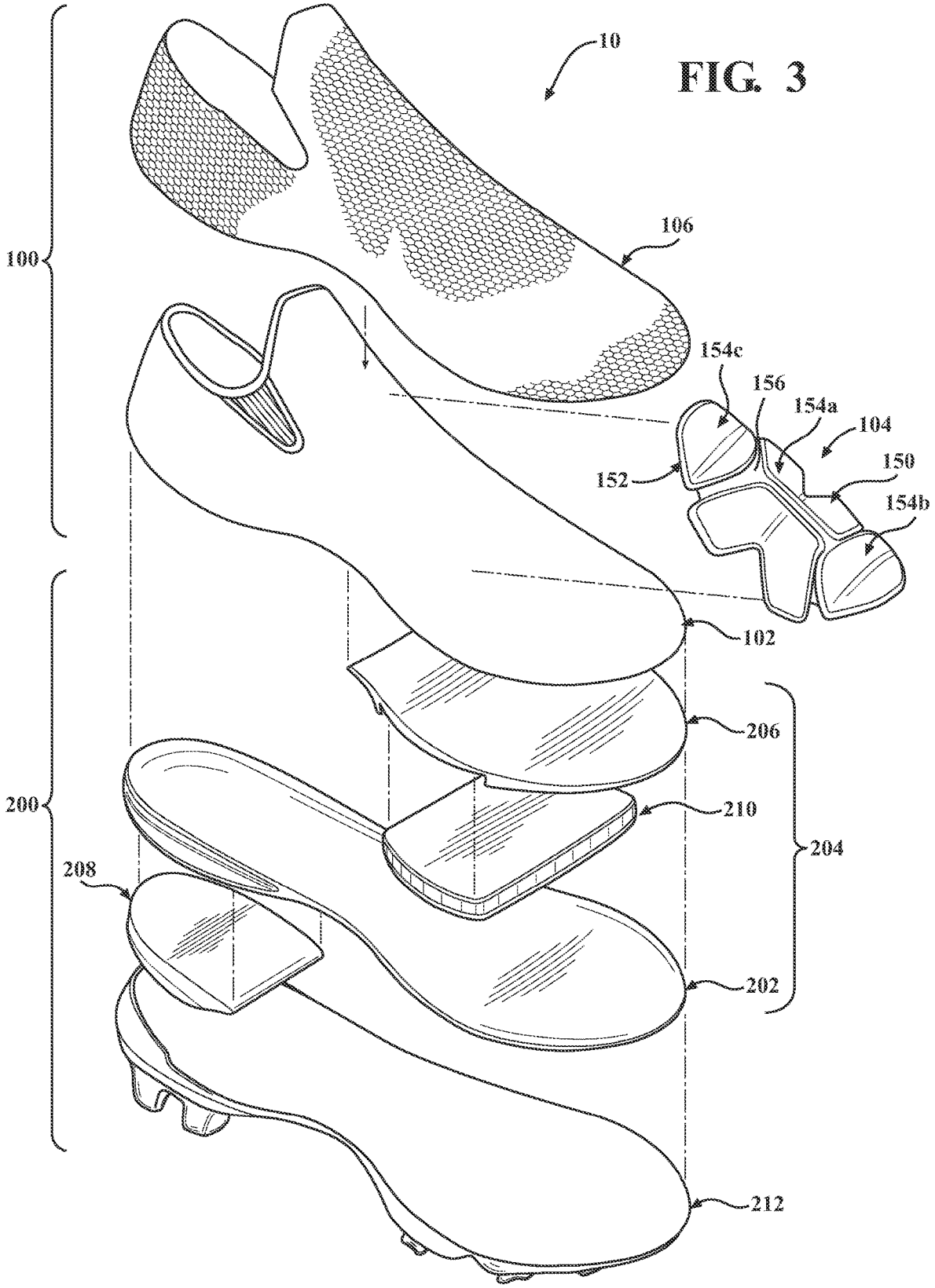
FIG. 3 is an exploded perspective view of the article of footwear of FIG. 1.

With reference to FIG. 3, the article of footwear 10 is shown in an exploded state including the upper 100 and the sole structure 200. As shown, the upper 100 includes an inner boot 102 configured to receive and secure a foot for support on the sole structure 200, a cushioning member 104 disposed on an exterior of the inner boot 102 along a dorsal portion of the foot, and a shroud 106 extending over the cushioning member 104 and the inner boot 102. Accordingly, the cushioning member 104 is interposed between the inner boot 102 and the shroud 106.

Figure 5:
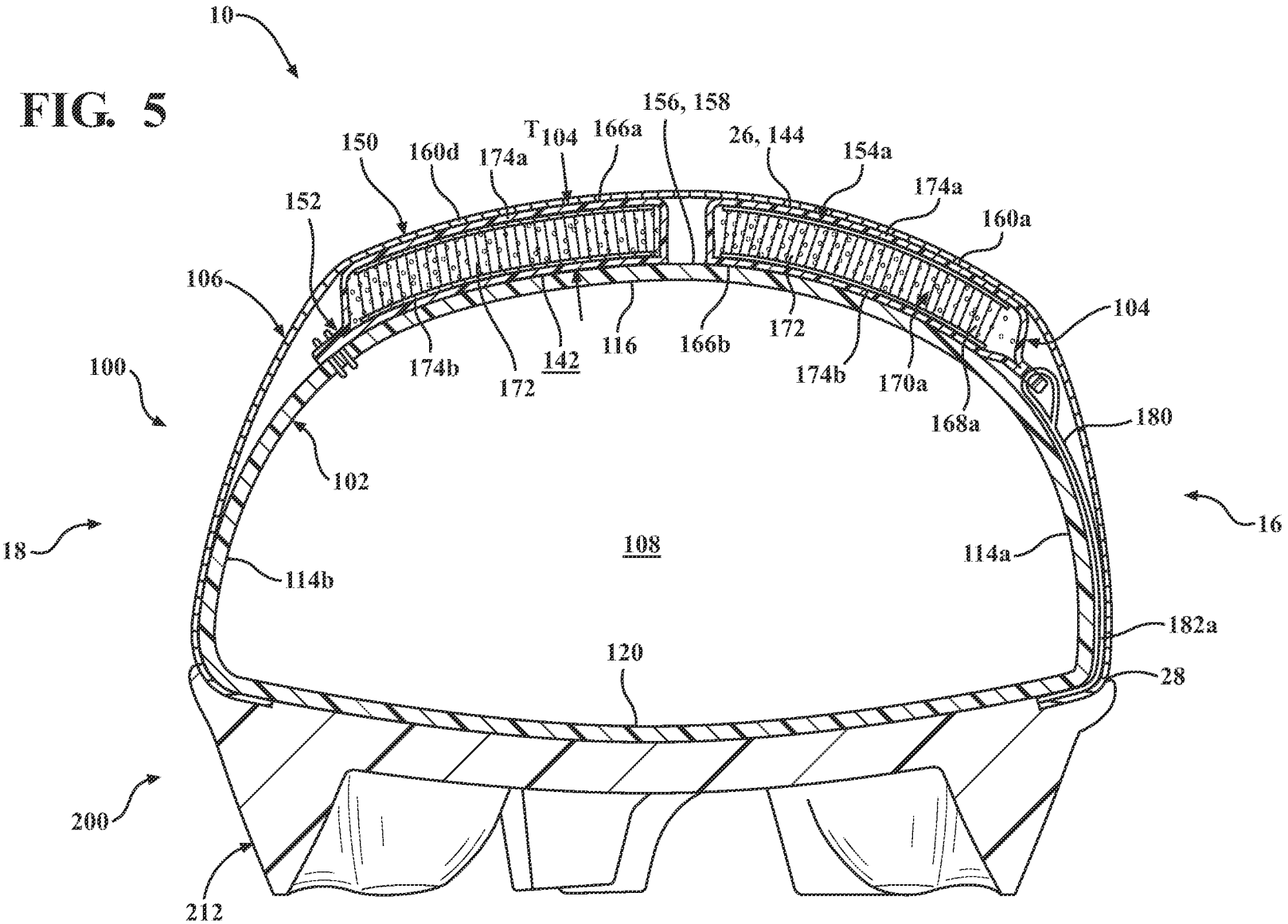
FIG. 5 is a cross-sectional view of the article of footwear of FIG. 1, taken along Line 5-5 in FIG. 4.
Figure 6:
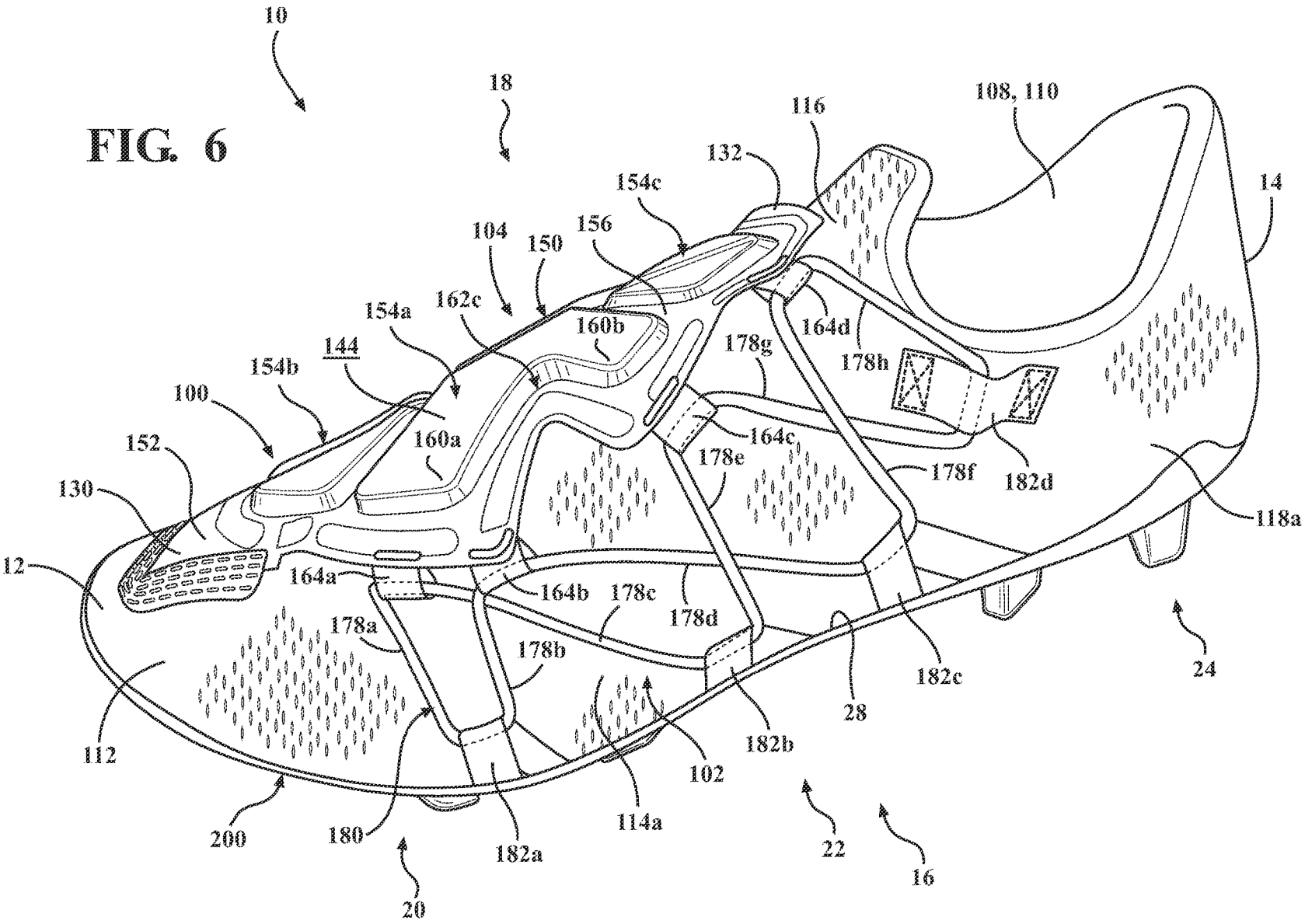
FIG. 6 is a top-front-lateral perspective view of the article of footwear of FIG. 1, where an outer shroud has been removed to show interior components of the article of footwear.
Figure 7:
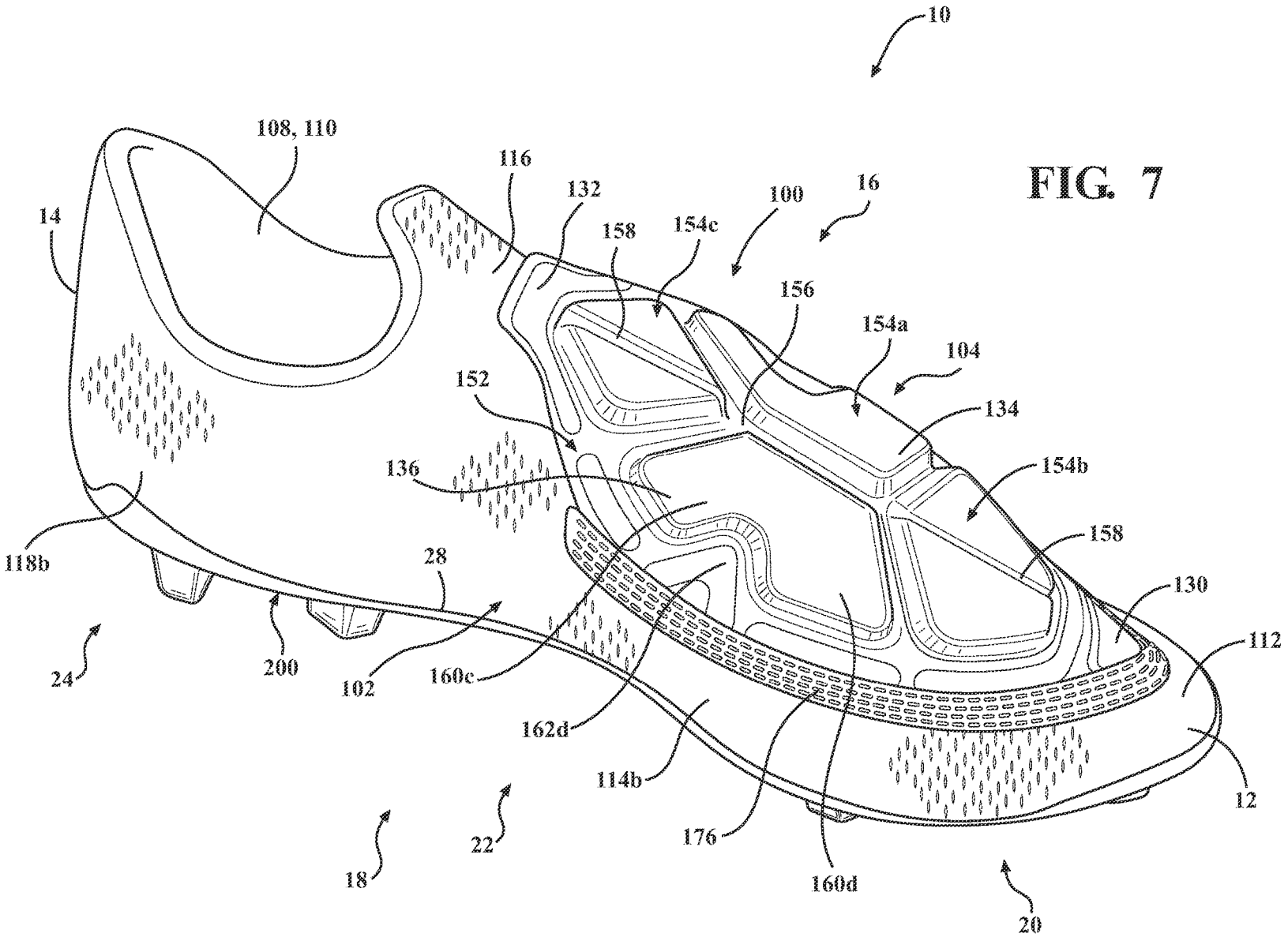
FIG. 7 is a top-front-medial perspective view of the article of footwear of FIG. 1, where an outer shroud has been removed to show interior components of the article of footwear.

With reference to FIGS. 6 and 7, the inner boot 102 of the upper 100 forms an enclosure having plurality of components that cooperate to define an interior void 108 and an ankle opening 110 of the article of footwear, which cooperate to receive and secure a foot for support on the sole structure 200. For instance, the inner boot 102 may be described as including a toe cap 112 disposed at the anterior end 12, which is configured to extend over and enclose the toes of the foot. The upper 100 further includes a pair of quarter panels 114*a*, 114*b* extending from the toe cap 112 and along opposite sides of the inner boot 102 in the mid-foot region 22. As used throughout, the inner boot 102 may be described as including an instep region 116 extending along a dorsal region of the foot from the toe cap 112 to the ankle opening 110, and connecting the quarter panels 114*a*, 114*b*. In the heel region 24, a pair of side panels 118*a*, 118*b* extend from each of the respective quarter panels 114*a*, 114*b* and along opposite sides of the ankle opening 110. As shown in the cross-sectional view of FIG. 5, the inner boot 102 may further include a strobel 120 enclosing a bottom portion of the interior void 108.

Unlike conventional uppers 100, which may include several distinct components forming each of the elements or regions, the upper 100 of the present disclosure may include one or more continuous pieces of material forming various layers of the upper 100. For example, the inner boot 102 of the upper 100 may be formed as one or more pieces of knitted material formed to define the various regions of the upper 100. Accordingly, the toe cap 112, the quarter panels 114*a*, 114*b*, the instep region 116, and the heel side panels 118*a*, 118*b* may be integrally formed of one or more continuous pieces of material. However, for the sake of describing the configurations and relative arrangements of the elements of the upper 100, conventional terminology will be used herein.

With reference to FIGS. 6 and 7, the upper 100 is shown with the shroud 106 removed to expose the inner boot 102 and the cushioning member 104. Generally, the cushioning member 104 is disposed over the instep region 116 of the inner boot 102 to provide an additional layer of cushioning along the dorsal portion of the foot. As described in greater detail below, the cushioning member 104 may not be directly attached to the inner boot 102, and instead may be allowed to "float" relative to the inner boot 102. Optionally, only a peripheral portion of the cushioning member 104 may be directly attached to the inner boot 102 so that the remainder of the cushioning member 104 is independent (i.e. floats) relative to the inner boot 102. For example, a peripheral portion of the cushioning member 104 may be fixed to the inner boot 102 along or adjacent to one of the quarter panels 114*a*, 114*b*, while the remainder of the cushioning member 104 is detached from the inner boot 102.

Figure 8:
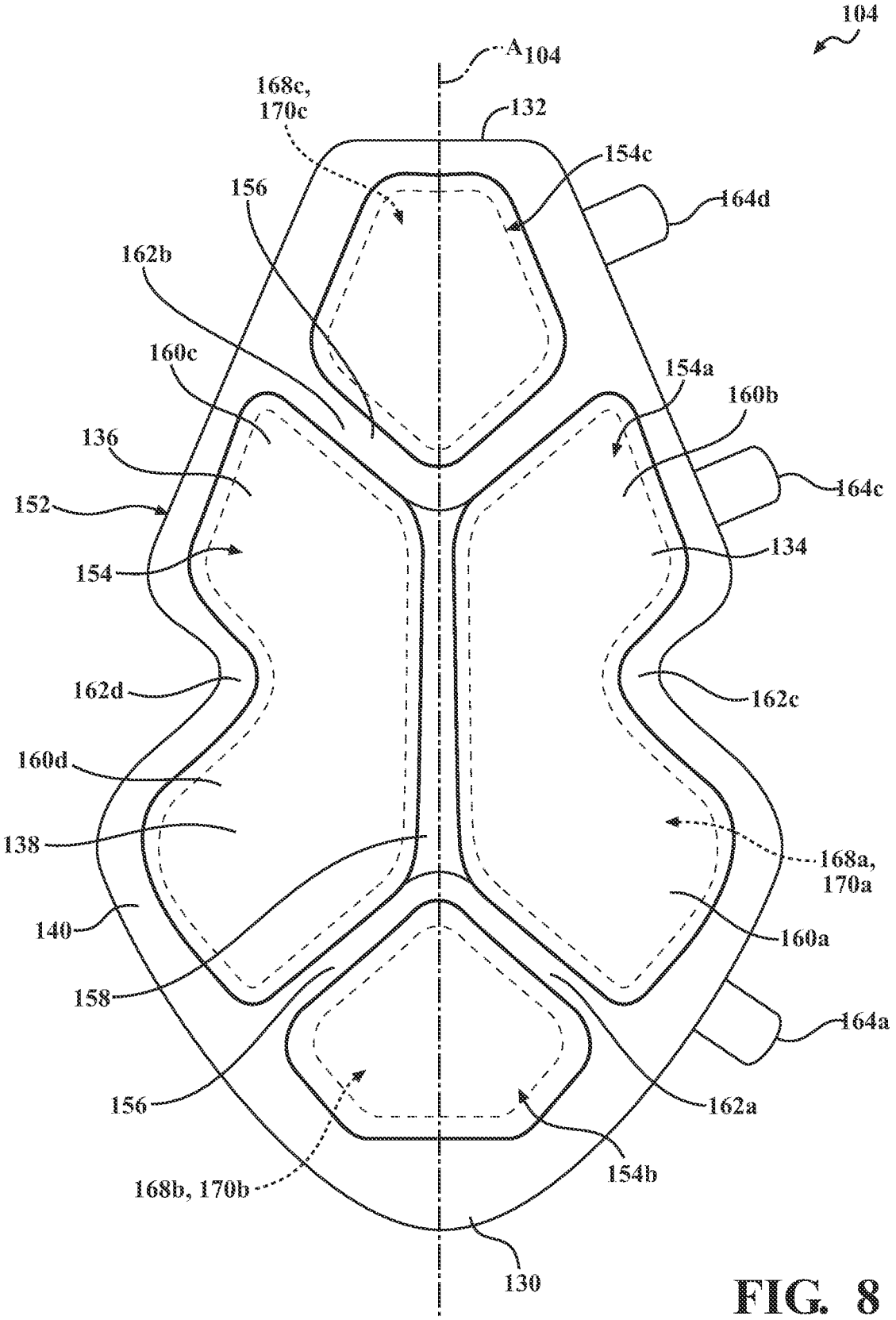
FIG. 8 is a top plan view of a cushioning member for an article of footwear according to the principles of the present disclosure.

With reference to FIGS. 6-8, the cushioning member 104 extends from a first end 130 to a second end 132 along a longitudinal axis $A_{104}$, which generally separates the cushioning member 104 into a first side 134 and a second side 136. When fitted to the upper 100, the first and second sides 134, 136 of the cushioning member 104 may correspond to lateral or medial sides 16, 18 of the upper 100, depending on whether the cushioning member 104 is attached to an article of footwear configured for a left foot or a right foot. As described in greater detail below, the cushioning member 104 includes an interior region 138 and a peripheral region 140 circumscribing the interior region 138 and defining an outer peripheral profile of the cushioning member 104.

The cushioning member 104 may be further described as including an inner surface 142 configured to face inwardly (e.g., towards the foot) and an exterior surface 144 formed on an opposite side of the cushioning member 104 from the inner surface 142. The exterior surface 144 is configured to face outwardly (e.g., away from the foot) and may define at least a portion of a ball-control surface 26 of the article of footwear 10. As discussed below, distances between the inner surface 142 and the exterior surface 144 define respective thicknesses $T_{104}$ of the cushioning member 104.

With continued reference to FIGS. 6-8, the cushioning member 104 includes a cushioning element 150 in the interior region 138, and a peripheral flange 152 surrounding the cushioning element 150 along the peripheral region 140. As shown in FIG. 8, the cushioning element 150 substantially defines the interior region 138 of the cushioning member 104, while the peripheral flange 152 substantially defines the peripheral region 140. The cushioning element 150 includes a portion of the cushioning member 104 having a greater thickness $T_{104}$ than the peripheral flange 152. As such, the cushioning element 150 is configured as a compressible portion of the cushioning member 104 for providing impact attenuation along the dorsal portion of the foot.

While the entire cushioning element 150 may be continuously formed as a single, unitary cushioning element 150 within the interior region 138, in the illustrated example, the cushioning element 150 includes a plurality of discrete pads 154*a*-154*c* connected to each other by a web area 156 within the interior region 138 of the cushioning member 104. Here, each of the pads 154*a*-154*c* defines a maximum thickness $T_{104}$ (i.e., greater than a thickness of the web area 156) of the interior region 138 to provide discrete impact attenuation zones within the interior region 138. As discussed in greater detail below, each of the pads 154*a*-154*c* may be configured with a different shape, hardness, thickness, and/or surface feature.

The interior region 138 may also include one or more articulation joints 156, 158 configured to allow the cushioning member 104 to flex and conform during use. For example, the web area 156 includes one or more segments extending between adjacent ones of the pads 154*a*-154*c*, where the web area 156 defines a minimum thickness $T_{104}$ (i.e., less than the thickness of the adjacent pads 154*a*-154*c*) of the interior region 138 to provide primary articulation joints between adjacent ones of the pads 154*a*-154*c*. Optionally, one or more of the pads 154*a*-154*c* may also include flexions 158 formed in or along an intermediate portion of the pad 154*a*-154*c*, where the pad 154*a*-154*c* includes a line or area having a reduced thickness $T_{104}$ (i.e., less than the maximum thickness of the pad 154*a*-154*c* and greater than the minimum thickness $T_{104}$ of the web area 156) to allow each of the pads 154 to flex or articulate.

In the illustrated example, the cushioning element 150 includes a plurality of the pads 154*a*-154*c* formed in the interior region 138. Here, each of the pads 154*a*-154*c* is separated by the web area 156, whereby the pads 154*a*-154*c* are able to articulate relative to one another. The plurality of the pads 154*a*-154*c* includes a central pad 154*a* interposed between a pair of end pads 154*b*, 154*c* formed at each end 130, 132 of the cushioning member 104. The central pad 154*a* may form a larger portion of the exterior surface 144 than either of the end pads 154*b*, 154*c*, such that the central pad 154*a* provides a primary contact surface of the cushioning member 104.

With reference to FIG. 8, the central pad 154*a* generally has an X-shaped geometry including four legs or segments 160*a*-160*d* projecting outwardly from a central point. As shown, a first one of the legs 160*a* extends towards the first end 130 along the first side 134 of the cushioning member 104, a second one of the legs 160*b* extends towards the second end 132 along the first side 136 of the cushioning member 104, a third one of the legs 160*c* extends towards the second end 132 along the second side 136 of the cushioning member 104, and a fourth one of the legs 160*d* extends towards the first end 130 along the second side 136 of the cushioning member 104.

With continued reference to FIG. 8, distal ends of adjacent ones of the legs 160*a*-160*d* are spaced apart from each other to form a plurality of notches 162*a*-162*d* in an outer periphery of the central pad 154*a*. For example, the central pad 154*a* includes a pair of end notches 162*a*, 162*b* disposed at opposite ends 130, 132 of the central pad 154*a*, and a pair of side notches 162*c*, 162*d* disposed at opposite sides 134, 136 of the central pad 154*a*. Particularly, a first end notch 162*a* is formed between the first leg 160*a* and the fourth leg 160*d*, and is aligned with the longitudinal axis $A_{104}$ at the first end 130 of the cushioning member 104. A second end notch 162*b* is formed between the second leg 160*b* and the third leg 160*c* and is aligned with the longitudinal axis $A_{104}$ at the second end 132 of the cushioning member 104. A third notch 162*c* is disposed between the first leg 160*a* and the second leg 160*b* on the first side 134, while a fourth notch 162*d* is disposed between the third leg 160*c* and the fourth leg 160*d*. The notches 162*a*-162*c* are configured to allow each of the legs 160*a*-160*d* to move independently of each other, thereby providing the central pad 154*a* with increased flexibility.

In the illustrated example, the central pad 154*a* includes a longitudinal flexion 158 extending along a direction of the longitudinal axis $A_{104}$. As discussed above, the flexion 158 may be formed in a portion of the central pad 154*a* having a partially reduced thickness. Here, the flexion 158 separates the first and second legs 160*a*, 160*b* from the third and fourth legs 160*c*, 160*d* to allow the first and second sides 134, 134 of the central pad 154*a* to articulate along the longitudinal axis $A_{104}$. In other examples, the longitudinal flexion 158 may be replaced by a portion of the web area 156 such that the first side 134 (e.g., first and second legs 160*a*, 160*b*) is separated from the second side 136 (e.g., third and fourth legs 160*c*, 160*d*) by a portion of the web area 156 extending along the longitudinal axis $A_{104}$. Optionally, the central pad 154*a* may include other flexions, such as a lateral flexion extending from the third notch 162*c* to the fourth notch 162*d*, or radial flexions extending along one or more of the legs 160*a*-160*d*.

In addition to the central pad 154*a*, the cushioning element 150 includes a first end pad 154*b* disposed at the first end 130 of the cushioning member 104. As shown, the first end pad 154*b* is at least partially received within the first end notch 162*a* of the central pad 154*a*, such that the first end pad 154*b* is overlapped by the central pad 154*a* at the first end 130. Here, the first end pad 154*a* may have a polygonal outer profile including a plurality of sides and vertices. The sides of the first end pad 154*b* may be adjacent and parallel to the sides of the central pad 154*a* defining the first end notch 162*a* such that a portion of the web area 156 extending between the first end pad 154*b* and the central pad 154*a* has a substantially constant width.

The cushioning element 150 also includes a second end pad 154*c* disposed at the second end 132 of the cushioning member 104. As shown, the second end pad 154*c* is at least partially received within the second end notch 162*b* of the central pad 154*a*, such that the second end pad 154*c* is overlapped by the central pad 154*a* at the second end 132. Here, the second end pad 154*c* may have a polygonal outer profile including a plurality of sides and vertices. Sides of the second end pad 154*c* may be adjacent and parallel to the sides of the central pad 154*a* defining the second end notch 162*b* such that a portion of the web area 156 extending between the second end pad 154*c* and the central pad 154*c* has a substantially constant width.

As provided above, the peripheral flange 152 extends around an outer periphery of the cushioning element 150 and provides an attachment interface for securing the cushioning member 104 to the upper 100. The peripheral flange 152 may define a portion of the cushioning member 104 having a minimum thickness $T_{104}$. Optionally, the peripheral flange 152 may include one or more conduits 164*a*-164*d* for securing the cushioning member 104 to the upper 100 as discussed below. In the illustrated example, the conduits 164*a*-164*d* are formed as fabric loops 164 attached to the peripheral flange 152 along the first side 134 of the cushioning member 104. In other examples, the conduits 164*a*-164*d* may be formed integrally with or through the peripheral flange 152.

In the illustrated example, the cushioning member 104 is formed as bladder 104 having an opposing pair of barrier layers 166*a*, 166*b* joined to each other at discrete locations to define the geometries (e.g., thicknesses, width, and lengths) of the cushioning member 104. For example, the barrier layers 166*a*, 166*b* may be joined together to form the web area 156 and the peripheral flange 152, which cooperate to bound and extend around the pads 154*a*-154*c*. Thus, each of the pads 154*a*-154*c* is associated with an area of the cushioning member 104 where interior surfaces of the upper and lower barrier layers 166*a*, 166*b* are not joined together and, thus, are separated from one another.

As shown in FIG. 5, spaces formed between opposing interior surfaces of the upper and lower barrier layers 166*a*, 166*b* define interior voids or chambers 168*a*-168*c* of each of the pads 154*a*-154*c*. Generally, each of the chambers 168*a*-168*c* is provided with a compressible material therein. For example, the chamber can be filled to include any suitable fluid, such as a gas or liquid. In an aspect, the gas can include air, nitrogen ($N_2$), or any other suitable gas. A fluid provided to the chamber 168*a*-168*c* can result in the pads 154*a*-154*c* being pressurized. Alternatively, a fluid provided to the chambers 168*a*-168*c* can be at atmospheric pressure such that the pads 154*a*-154*c* are not pressurized but, rather, simply contain a volume of fluid at atmospheric pressure. In other aspects, the chambers 168*a*-168*c* can alternatively include other compressible material, such as elastomeric pads, pellets, beads, and the like (e.g., foamed beads and/or rubber beads).

When filled with a pressurized fluid, the chambers 168*a*-168*c* of the pads 154*a*-154*c* may receive a tensile element 170*a*-170*c* therein. Each tensile element 170*a*-170*c* may include a series of tensile strands 172 extending between upper and lower tensile layers 174*a*, 174*b*. The upper tensile layer 174*a* may be attached to the upper barrier layer 166*a* while the lower tensile layer 174*b* may be attached to the lower barrier layer 166*b*. In this manner, when each of the chambers 168*a*-168*c* receives a pressurized fluid, the tensile strands 172 of the tensile elements 170*a*, 170*b* are placed in tension. Because the upper tensile layer 174*a* is attached to the first barrier layer 166*a* and the lower tensile layer 174*b* is attached to the lower barrier layer 166*a*, 166*b*, the tensile strands 172 retain a desired shape of each of the pads 154*a*-154*c* when the pressurized fluid is injected into the chamber 168*a*-168*c*.

As used herein, the term "barrier layer" (e.g., barrier layers 166*a*, 166*b*) encompasses both monolayer and multilayer films. In some embodiments, one or both of barrier layers 166*a*, 166*b* are each produced (e.g., thermoformed or blow molded) from a monolayer film (a single layer). In other embodiments, one or both of the barrier layers 166*a*, 166*b* are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 166*a*, 166*b* can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 166*a*, 166*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 166*a*, 166*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 166*a*, 166*b* include two or more sublayers, examples of suitable multilayer films include microlayer films, such as those disclosed in Bonk et al., U.S. Pat. No. 6,582,786, which is incorporated by reference in its entirety. In further embodiments, the barrier layers 166*a*, 166*b* may each independently include alternating sublayers of one or more TPU copolymer materials and one or more EVOH copolymer materials, where the total number of sublayers in each of the barrier layers 166*a*, 166*b* includes at least four (4) sublayers, at least ten (10) sublayers, at least twenty (20) sublayers, at least forty (40) sublayers, and/or at least sixty (60) sublayers.

The member 104 can be produced from barrier layers 166*a*, 166*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, barrier layers 166*a*, 166*b* can be produced by co-extrusion followed by vacuum thermoforming to produce an inflatable chamber, which can optionally include one or more valves (e.g., one way valves) that allows the chambers to be filled with the fluid (e.g., gas).

The barrier layers 166*a*, 166*b* desirably have a low gas transmission rate to preserve its retained gas pressure. In some embodiments, barrier layers 166*a*, 166*b* have a gas transmission rate for nitrogen gas that is at least about ten (10) times lower than a nitrogen gas transmission rate for a butyl rubber layer of substantially the same dimensions. In an aspect, fluid-filled chamber 220 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 166*a*, 166*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

While the illustrated example of the cushioning member 104 is formed as a unitary bladder, in some examples, the cushioning member 104 may be formed as a composite structure having various components and materials joined together to form the elements of the cushioning member 104. For example, the cushioning member 104 may be formed by attaching one or more of the pads 154*a*-154*c* to a flexible substrate defining the peripheral flange 152 and/or the web area 156. Here, one or more of the pads 154*a*-154*c* may include a compressible chamber, similar to those described above. Additionally or alternatively, one or more of the pads 154*a*-154*c* may be formed of a resilient material, such as a foam material. In other examples, the cushioning element 150 and the peripheral flange 152 may be formed as a homogenous structure (i.e., of a single material). For instance, the cushioning element 150 and the peripheral flange 152 may be integrally molded from a single piece of an elastomeric material, such as a rubber or foamed rubber material.

With continued reference to FIGS. 6 and 7, the article of footwear 10 is shown with the shroud 106 removed to illustrate the arrangement of the cushioning member 104 on the inner boot 102. As shown, the cushioning member 104 is arranged with the first end 130 adjacent to the toe cap 112 and the second end 132 adjacent to the ankle opening 110. Accordingly, the cushioning member 104 extends over the instep region 116 of the inner boot 102. In some examples, the longitudinal axis $A_{104}$ is substantially aligned along the longitudinal axis $A_{10}$ of the footwear 10.

As shown in FIGS. 5-7, the cushioning member 104 is only partially attached to the inner boot 102 so that a portion of the cushioning member 104 is able to float relative to the exterior of the inner boot 102. Accordingly, the inner boot 102 may be allowed to stretch and twist free of any restrictions that may be imparted by the materials of the cushioning member 104. In the illustrated example, the second side 136 cushioning member 104 is attached directly to the inner boot 102 while the first side 134 is detached from the inner boot 102.

With reference to FIG. 7, the second side 136 of the cushioning member 104 is fixed to the medial side 18 of the inner boot 102 along the peripheral flange 152 so that the interior region 138 of the cushioning member 104 is independent of the inner boot 102. In the illustrated example, the peripheral flange 152 is fixed to the inner boot 102 by a series of fasteners 176. The fasteners 176 of the present example are embodied as stitches extending continuously from the first end 130 to the second end 132 along the peripheral flange 152 on the second side 136. However, other means of fastening, such as mechanical fasteners, welds, or adhesives may be used.

Turning to FIG. 6, the first side 134 of the cushioning member 104 is not directly attached to the inner boot 102. Instead, the first side 134 of the cushioning member 104 is secured to the article of footwear 10 by a series of tethers 178*a*-178*h* extending from the peripheral flange 152 to the bite line 28 formed between the upper 100 and the sole structure 200. Optionally, the tethers 178*a*-178*h* may include an elastic material that maintains a continuous biasing force along the first side 134 of the cushioning member 104 while still allowing the cushioning member 104 to move independently of the inner boot 102 and the sole structure 200. The biasing force may bias the first side 134 of the cushioning member 104 in a direction toward the bite line 28 and, thus, toward a ground-contacting surface of the article of footwear 10.

In the illustrated example, the tethers 178*a*-178*h* are formed as segments of a continuous, unitary strand 180 alternatingly routed between the cushioning member 104 and various attachment points on the article of footwear 10. As shown, the article of footwear 10 may include a plurality of anchors 182*a*-182*d* attached at the bite line 28 and/or along the inner boot 102 for securing the tethers 178*a*-178*h*. Where the tethers 178*a*-178*h* are formed as part of a single strand 180, the anchors 182*a*-182*d* may be formed as loops or guides through which the strand 180 is routed. However, in other examples, where the tethers 178*a*-178*h* are independently formed, the anchors 182*a*-182*d* may be distinct attachment points for respective ends of each of the tethers 178*a*-178*h*.

With continued reference to FIG. 6, the cushioning member 104 includes a series of the conduits 164*a*-164*d* (e.g., fabric loops) arranged in series along the first side 134 and the article of footwear 10 includes a corresponding series of the anchors 182*a*-182*d* (e.g., fabric loops) arranged in series along the bite line 28 and the inner boot 102. Here, the strand 180 forms a first tether 178*a* connecting a first conduit 164*a* and a first anchor 182*a* attached at the bite line 28, a second tether 178*b* connecting the first anchor 182*a* and a second conduit 164*b*, a third tether 178*c* connecting the first conduit 164*a* and a second anchor 182*b* attached at the bite line 28, a fourth tether 178*d* connecting the second conduit 164*b* and a third anchor 182*c* attached at the bite line 28, a fifth tether 178*e* connecting the second anchor 182*b* and a third conduit 164*c*, a sixth tether 178*f* connecting the third anchor 182*c* and a fourth conduit 164*d*, a seventh tether 178*g* connecting the third conduit 164*c* and a fourth anchor 182*d* attached to the inner boot 102, and an eighth tether 178*h* connecting the fourth conduit 164*d* and the fourth anchor 182*d*.

Figure 2:
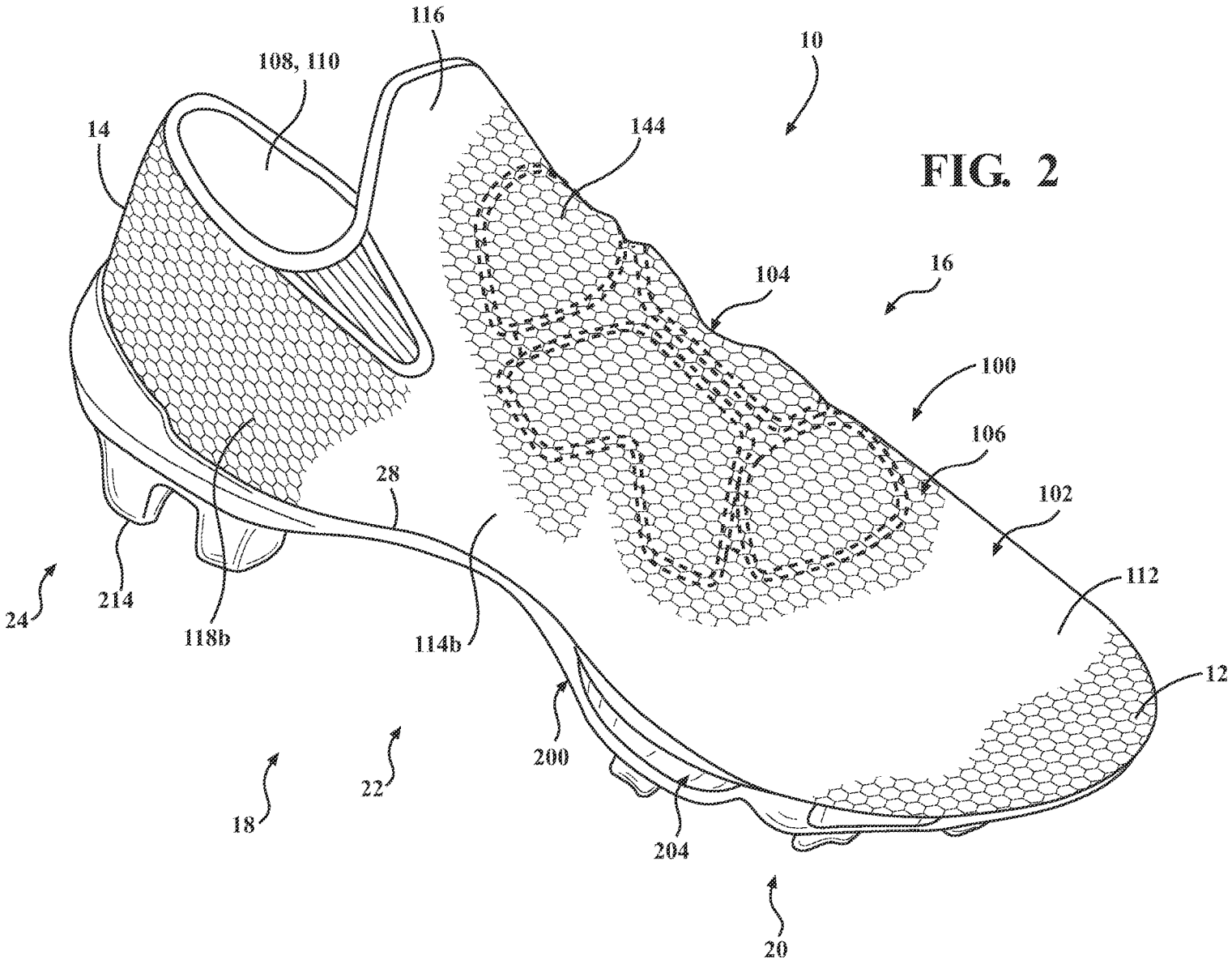
FIG. 2 is a top-front-medial perspective view of the article of footwear of FIG. 1.

With continued reference to FIGS. 1-3, the inner boot 102 and the cushioning member 104 are partially concealed within the shroud 106. In the illustrated example, the shroud 106 is formed as a full shroud 106 configured to cover an entirety of the upper 100. However, the shroud 106 may be configured as a partial shroud 106 extending only over selected regions of the upper 100. Optionally, the shroud 106 may be formed of a material having a relatively high coefficient of friction to provide increased grip along the exterior of the upper 100.

The shroud 106 includes an elastic material configured to stretch with the inner boot 102, and may include a plurality of perforations 190*a*, 190*b* formed through a thickness of the shroud 106 for at least partially exposing the inner boot 102 and/or the cushioning member 104. Accordingly, the shroud 106 may cooperate with the exterior surface 144 of the cushioning member 104 and the inner boot 102 to form the ball-control surface 26 of the article of footwear 10. Furthermore, the perforations 190*a*, 190*b* may vary in size and shape along the shroud 106 to provide more or less exposure to the inner boot 102 and/or the cushioning member 104. For instance, the perforations 190*b* configured to overlay the cushioning member 104 may be larger than perforations 190*a* surrounding the cushioning member 104. The larger perforations 190*b* overlying the cushioning member 104 maximize an area of the exterior surface 144 of the cushioning member 104 that is exposed, thereby providing improved ball control properties along the instep region 116.

Figure 9:
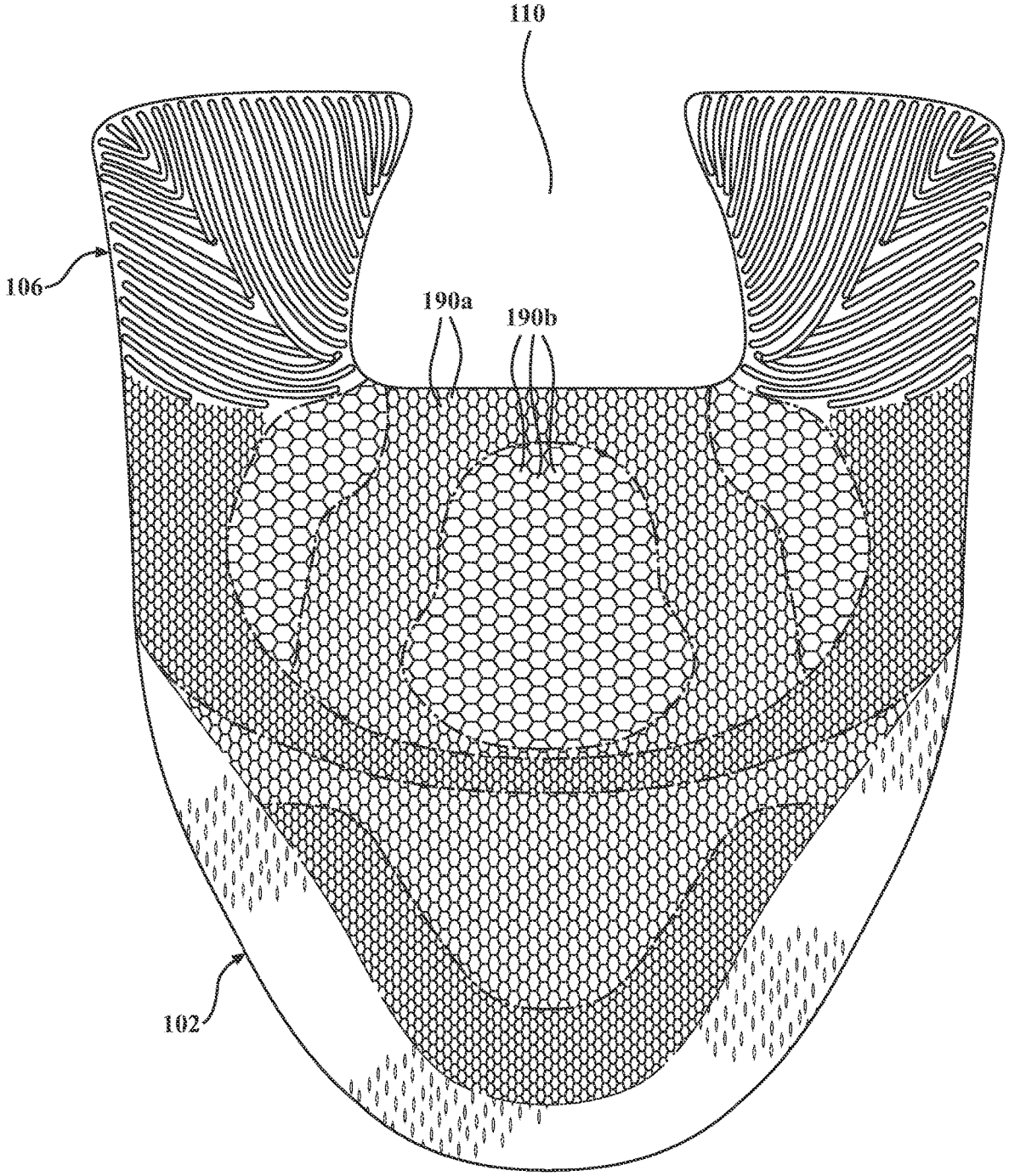
FIG. 9 is a plan view of a knitted carcass for an upper of an article of footwear according to the principles of the present disclosure.
Figure 10:
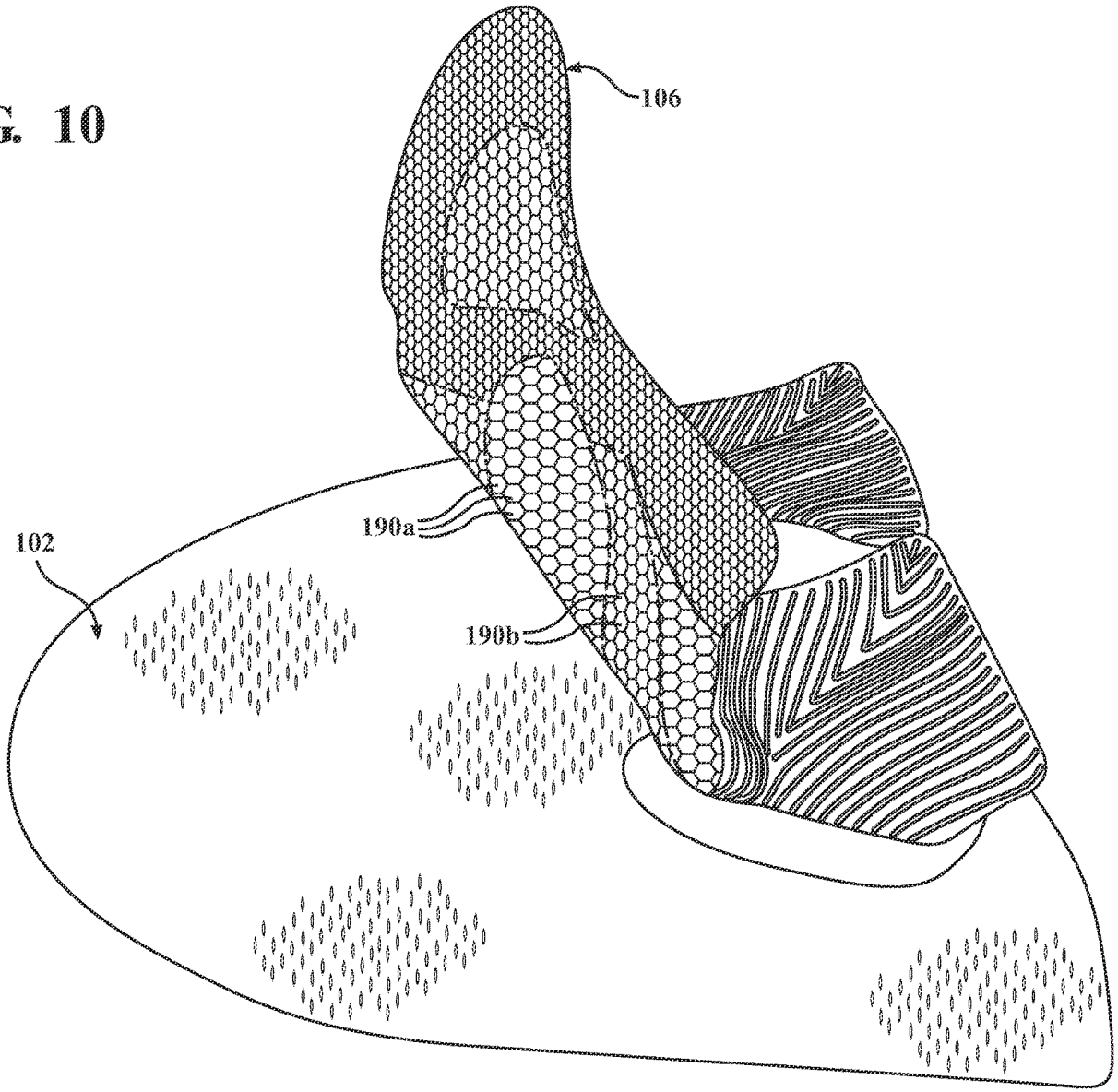
FIG. 10 is a perspective view of the knitted carcass of FIG. 9.

In some examples, the shroud 106 may be a knitted material having a desired degree of elasticity. As shown in FIGS. 9 and 10, the shroud 106 may be integrally knitted with the inner boot 102 to provide a carcass of the upper 100. FIGS. 9 and 10 show the inner boot 102 and the shroud 106 in a flat state prior to formation into the upper 100. Here, the inner boot 102 has a first knit pattern and the shroud 106 has a second knit pattern. The inner boot 102 and the shroud 106 are attached to each other around the portion corresponding to the ankle opening 110. During assembly, the cushioning member 104 may be interposed between the knitted layers of the inner boot 102 and the shroud 106. This configuration minimizes manufacturing complexities by initially providing the knitted layers as a single component.

With reference to FIGS. 1-3, the sole structure 200 may include a chassis plate 202 extending between the lateral side 16 and the medial side 18 from the anterior end 12 to the posterior end 14. In this example, the sole structure 200 further includes a midsole 204 including a forefoot pad 206 disposed adjacent the anterior end 12 article of footwear 10, a heel pad 208 disposed adjacent the posterior end 14 of the article of footwear 10, and a cushion 210 disposed in the forefoot region 20. An outsole plate 212 is attached to the midsole 204 and defines a ground-engaging surface of the article of footwear 10. The outsole plate 212 may include one or more traction elements 214 for engaging the ground surface.

The following Clauses provide an exemplary configuration for an article of footwear described above.

Clause 1. An upper for an article of footwear, the upper comprising an inner boot including an ankle opening and an instep region formed between the ankle opening and an anterior end of the upper and a cushioning member disposed over the instep region of the inner boot and including a first side fixed to a medial side of the upper and a second side tethered to a lateral side of the upper.

Clause 2. The upper of Clause 1, wherein the cushioning member includes one or more compressible pads.

Clause 3. The upper of Clause 2, wherein each of the compressible pads includes a chamber having a compressible material disposed therein.

Clause 4. The upper of Clause 2, wherein the one or more compressible pads includes a central pad and a pair of secondary pads disposed at opposite ends of the central pad.

Clause 5. The upper of Clause 4, wherein the central pad is X-shaped.

Clause 6. The upper of any of the preceding Clauses, wherein the inner boot includes a knitted mesh material.

Clause 7. The upper of any of the preceding Clauses, further comprising a shroud attached to the inner boot and at least partially covering the cushioning member.

Clause 8. The upper of Clause 7, wherein the shroud includes a plurality of perforations through which the cushioning member is exposed.

Clause 9. The upper of any of the preceding Clauses, wherein the second side of the cushioning member is detached from the inner boot.

Clause 10. The upper of Clause 9, wherein the second side of the cushioning member is tethered to the lateral side of the upper by a plurality of connecting strands.

Clause 11. An upper for an article of footwear, the upper comprising an inner boot including an ankle opening and an instep region formed between the ankle opening and an anterior end of the upper and a cushioning member disposed over the instep region of the inner boot and including a peripheral portion attached to one of a medial side and a lateral side of the inner boot and an interior portion detached from the inner boot.

Clause 12. The upper of Clause 11, wherein the cushioning member includes one or more compressible pads.

Clause 13. The upper of Clause 12, wherein each of the compressible pads includes a chamber having a compressible material disposed therein.

Clause 14. The upper of Clause 12, wherein the one or more compressible pads includes a central pad and a pair of secondary pads disposed at opposite ends of the central pad.

Clause 15. The upper of Clause 14, wherein the central pad is X-shaped.

Clause 16. The upper of any of the preceding Clauses, wherein the inner boot includes a knitted mesh material.

Clause 17. The upper of any of the preceding Clauses, further comprising a shroud attached to the inner boot and at least partially covering the cushioning member.

Clause 18. The upper of Clause 17, wherein the shroud includes a plurality of perforations through which the cushioning member is exposed.

Clause 19. The upper of any of the preceding Clauses, wherein a first portion of the peripheral portion is detached from the inner boot.

Clause 20. The upper of any of the preceding Clauses, wherein a first portion of the peripheral portion is tethered to the upper by a plurality of connecting strands.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An article of footwear comprising:

a sole structure;

an inner boot attached to the sole structure along a bite line and including an ankle opening and an instep region formed between the ankle opening and an anterior end of the inner boot; and a cushioning member disposed over the instep region of the inner boot and including a first side fixed to a medial side of the inner boot and a second side attached by a tether to one or more anchors extending from the bite line along a lateral side of the inner boot, the cushioning member including at least two compressible pads between the medial side and the lateral side of the inner boot and joined together by a longitudinal flexion of a web along a longitudinal axis to define an X-shape divided by the longitudinal axis, the longitudinal flexion extending from proximate to the ankle opening to proximate to a toe cap of the inner boot, the at least two compressible pads being spaced apart from each other along the longitudinal axis, the web configured to allow the at least two compressible pads to bend about the longitudinal flexion, each of the at least two compressible pads including legs that converge at a central point to define the X-shape and a tensile element disposed between a first film layer and a second film layer.

2. The article of footwear of claim 1, wherein each of the compressible pads includes a chamber having a compressible material disposed therein.

3. The article of footwear of claim 1, wherein the at least two compressible pads includes a central pad and a pair of secondary pads disposed at opposite ends of the central pad.

4. The article of footwear of claim 1, wherein the inner boot includes a knitted mesh material.

5. The article of footwear of claim 1, further comprising a shroud attached to the inner boot and at least partially covering the cushioning member.

6. The article of footwear of claim 5, wherein the shroud includes a plurality of perforations through which the cushioning member is exposed.

7. The article of footwear of claim 1, wherein the second side of the cushioning member is detached from the inner boot.

8. The article of footwear of claim 7, wherein the tether includes a plurality of independently formed connecting strands.

9. An article of footwear comprising:

a sole structure;

an inner boot attached to the sole structure along a bite line and including an ankle opening and an instep region formed between the ankle opening and an anterior end of the inner boot; and a cushioning member disposed over the instep region of the inner boot and including (i) an interior portion detached from the inner boot and (ii) a peripheral portion attached by a tether to one or more anchors extending from the bite line between the sole structure and at least one of a medial side and a lateral side of the inner boot, the cushioning member including at least two compressible pads between the medial side and the lateral side of the inner boot and joined together by a longitudinal flexion of a web along a longitudinal axis to define an X-shape divided by the longitudinal axis, the at least two compressible pads being spaced apart from each other along the longitudinal axis, the web configured to allow the at least two compressible pads to bend about the longitudinal flexion, each of the at least two compressible pads including legs that converge at a central point to define the X-shape and a tensile element disposed between a first film layer and a second film layer.

10. The article of footwear of claim 9, wherein each of the compressible pads includes a chamber having a compressible material disposed therein.

11. The article of footwear of claim 9, wherein the at least two compressible pads includes a central pad and a pair of secondary pads disposed at opposite ends of the central pad.

12. The article of footwear of claim 9, wherein the inner boot includes a knitted mesh material.

13. The article of footwear of claim 9, further comprising a shroud attached to the inner boot and at least partially covering the cushioning member.

14. The article of footwear of claim 13, wherein the shroud includes a plurality of perforations through which the cushioning member is exposed.

15. The article of footwear of claim 9, wherein a first portion of the peripheral portion is detached from the inner boot.

16. The article of footwear of claim 9, wherein the tether includes a plurality of independently formed connecting strands.

17. The article of footwear of claim 1, wherein at least one of the at least two compressible pads includes a fluid-filled chamber and the tensile element disposed in the fluid-filled chamber.

18. The article of footwear of claim 9, wherein at least one of the at least two compressible pads includes a fluid-filled chamber and the tensile element disposed in the fluid-filled chamber.

19. The article of footwear of claim 1, wherein the at least two compressible pads include a plurality of notches defined by the legs at an outer periphery of the at least two compressible pads, the plurality of notches configured to allow each of the legs to move independently of each other.

20. The article of footwear of claim 9, wherein the at least two compressible pads include a plurality of notches defined by the legs at an outer periphery of the at least two compressible pads, the plurality of notches configured to allow each of the legs to move independently of each other.

* * * * *